US005183405A

United States Patent [19]

Elicker et al.

[11] Patent Number: 5,183,405

[45] Date of Patent: Feb. 2, 1993

[54] GROUNDED ELECTRICAL CONNECTOR ASSEMBLY

[75] Inventors: Robert W. Elicker, Dillsburg; Daniel L. Gorenc, Harrisburg, both of Pa.

[73] Assignee: AMP Incorporated, Harrisburg, Pa.

[21] Appl. No.: 811,497

[22] Filed: Dec. 20, 1991

[51] Int. Cl.[5] ..... H01R 13/652

[52] U.S. Cl. ..... 439/108

[58] Field of Search ..... 439/92, 101, 108

[56] References Cited

U.S. PATENT DOCUMENTS

| | | | |
|---|---|---|---|
| 4,558,917 | 12/1985 | Kamono et al. | 339/143 R |
| 4,611,867 | 9/1986 | Ichimura et al. | 39/14 R |
| 4,616,893 | 10/1986 | Feldman | 439/108 |
| 4,711,506 | 12/1987 | Tanaka | 439/108 |
| 4,712,849 | 12/1987 | Seidel et al. | 439/607 |
| 4,762,500 | 8/1988 | Dola et al. | 439/101 |
| 4,806,110 | 2/1989 | Lindeman | 439/108 |
| 4,907,979 | 3/1990 | Feldman | 439/83 |
| 4,992,056 | 2/1991 | Douty et al. | 439/83 |
| 5,057,028 | 10/1991 | Lemke et al. | 439/101 |

*Primary Examiner*—Gary F. Paumen

[57] ABSTRACT

An electrical connector assembly (10) includes first and second matable connectors (12,52), each having a housing (14,54) with at least two rows of teminal-receiving passageways (32,72) extending between mating and mounting faces thereof, each having a terminal member (34,74) mounted therein. One connector (12) further includes an elongate electrically conductive ground bus means (40) extending between two rows of terminal members (34) and securable to the housing (14). The ground bus means (40) includes first ground engagement means (42) adapted to electrically engage a ground means of the assembly. The ground bus means (40) further has means (44) for securing the respective housing (14) to a circuit board (96) and concomitantly therewith electrically interconnect the bus means 40 to respective circuits thereof. The other connector (52) includes a ground contact (80) having second ground engagement means (88) adapted to electrically engage the first ground engagement (42) means upon mating the connectors (12,52). The ground contact (80) further including means (90) for securing the connector (52) to a second circuit board (102) and concomitantly therewith electrically interconnect the ground contact (80) to ground means of the assembly. The first and second ground engagement means (42,88) are exposed along respective connector mating faces (16,56) and are adapted to go past each other and bear against each other under spring bias when the connectors (12,52) are mated.

10 Claims, 3 Drawing Sheets

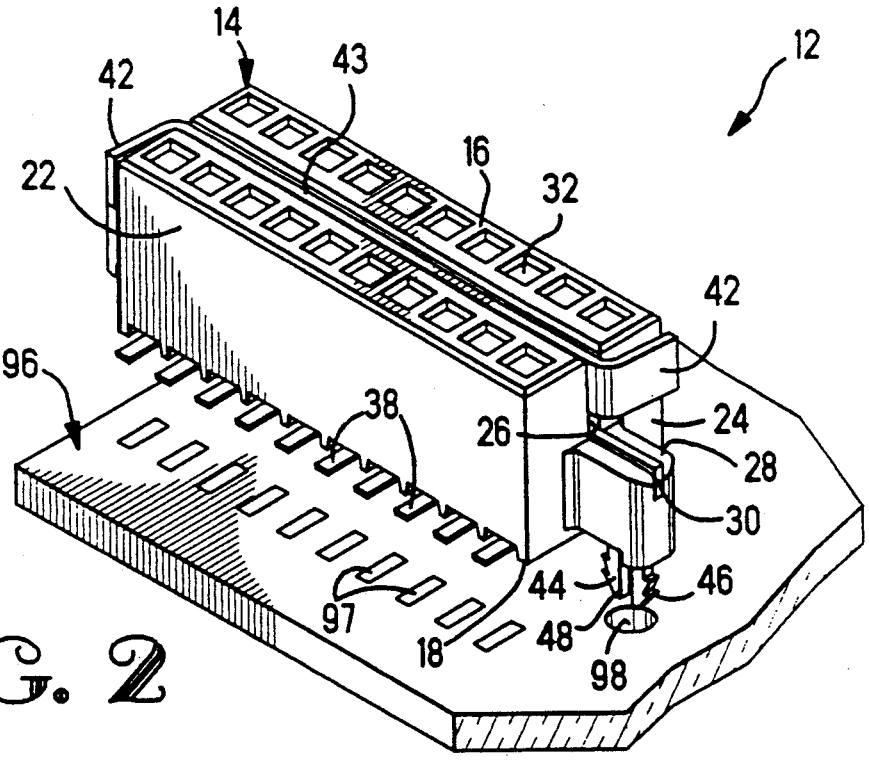
FIG. 2
FIG. 3
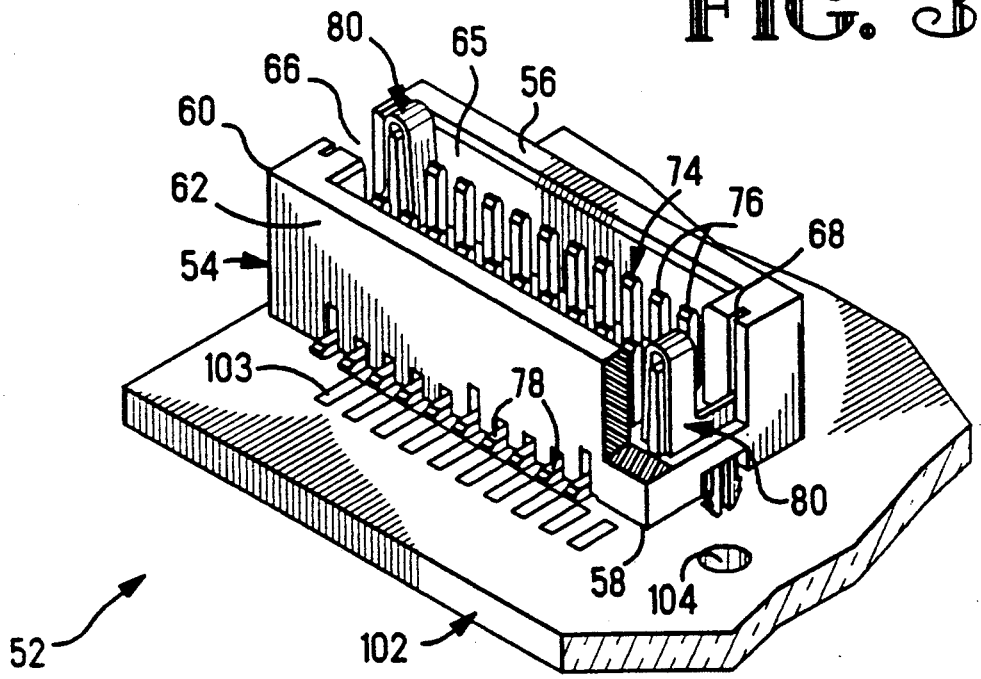

GROUNDED ELECTRICAL CONNECTOR ASSEMBLY

FIELD OF THE INVENTION

The present invention relates to electrical connectors for mounting to circuit boards and more particularly to high density connectors having ground planes to minimize cross talk.

BACKGROUND OF THE INVENTION

The continued trend towards high speed-high density circuity has created greater need for electrical connectors having ground planes located between rows of contacts to minimize cross talk between the signal carrying contacts. The high density circuitry furthermore has increased the desirability to use surface mount contacts to minimize the number of plated through holes required to mount the connector and electrically connect the corresponding terminal members to circuity within a circuit board. The surface mount connectors also minimize the real estate required on the board. Surface mount connectors, however, require some means of second fastening means to secure the connector to the board to eliminate or minimize problems with cracking of solder or the like at the surface interconnections. In addition it is also desirable to minimize the number of separate parts required to make the connectors.

U.S. Pat. No. 4,907,979 discloses a miniature high density, surface mounted connector having a pair of mating housing members, including an integral power or ground bus bar. A bus bar extends through an elongated longitudinally extending groove of each housing member. The connectors are further provided with a H-shaped clip for engaging the bus bars when the plug and receptacle members are mated.

SUMMARY OF THE INVENTION

Accordingly the present invention is directed to a high density connector assembly that alleviates problems and disadvantages associated with the prior art. The electrical connector assembly includes first and second matable connectors each having a housing and a plurality of terminal members arranged in rows parallel to housing side walls. One of the connectors includes an elongate electrically conductive ground bus means extending essentially parallel to the housing side walls and between two rows of terminal members and extending from an inner base surface to the mating face of the housing. In the preferred embodiment, the bus means is a continuous integral member extending substantially the full length of the housing and securable to the housing end walls. The ground bus means includes first ground engagement means at opposite ends thereof adapted to electrically engage a ground means of the mating connector. The ground bus means further includes means for securing the respective housing to an associated circuit board and concomitantly therewith electrically interconnect the bus to respective circuits of the board. The other connector includes a ground contact securable to an end wall of its housing, the ground contact including a second ground engagement means that is adapted to electrically engage with the first ground engagement means upon the two connectors being mated. The second ground contact also includes means for securing the other housing to its associated circuit board and concomitantly therewith electrically interconnect the ground contact to ground means of that board. Both the first and second ground engagement means are exposed along the respective mating faces of the connectors such that upon mating the connectors, the first and second ground engagement means go past each other and bear against each other under spring bias.

This invention is further directed to an improved grounding means suitable for use with miniature highly dense connectors wherein the structure of the ground engagement means of the plug and receptacle members are integral with the ground contact means and provide a spring bias means upon mating.

It is an object of the present invention to provide a high density connector having a ground plane located between the rows of signal terminal members to minimize cross talk.

It is a further object of the invention to provide ground means wherein the connector can be secured to the circuit board and electrically connected to the ground means of the assembly.

It is a further object of the invention to provide ground contacts that are in a make first, break last arrangement.

An embodiment of the present invention will now be described by way of example with reference to the accompanying drawings.

BRIEF DESCRIPTION OF THE DRAWINGS

FIG. 2 is an assembled receptacle made in accordance with the invention with the receptacle rotated to show the mating face.

FIG. 3 is a perspective view of the assembled plug of the present invention.

DETAILED DESCRIPTION OF THE DRAWINGS

For purposes of illustrating this invention the improved ground bus means is being shown with connector of the type described in U.S. Pat. No. 4,992,056, which is incorporated by reference herein.

Figure 1:
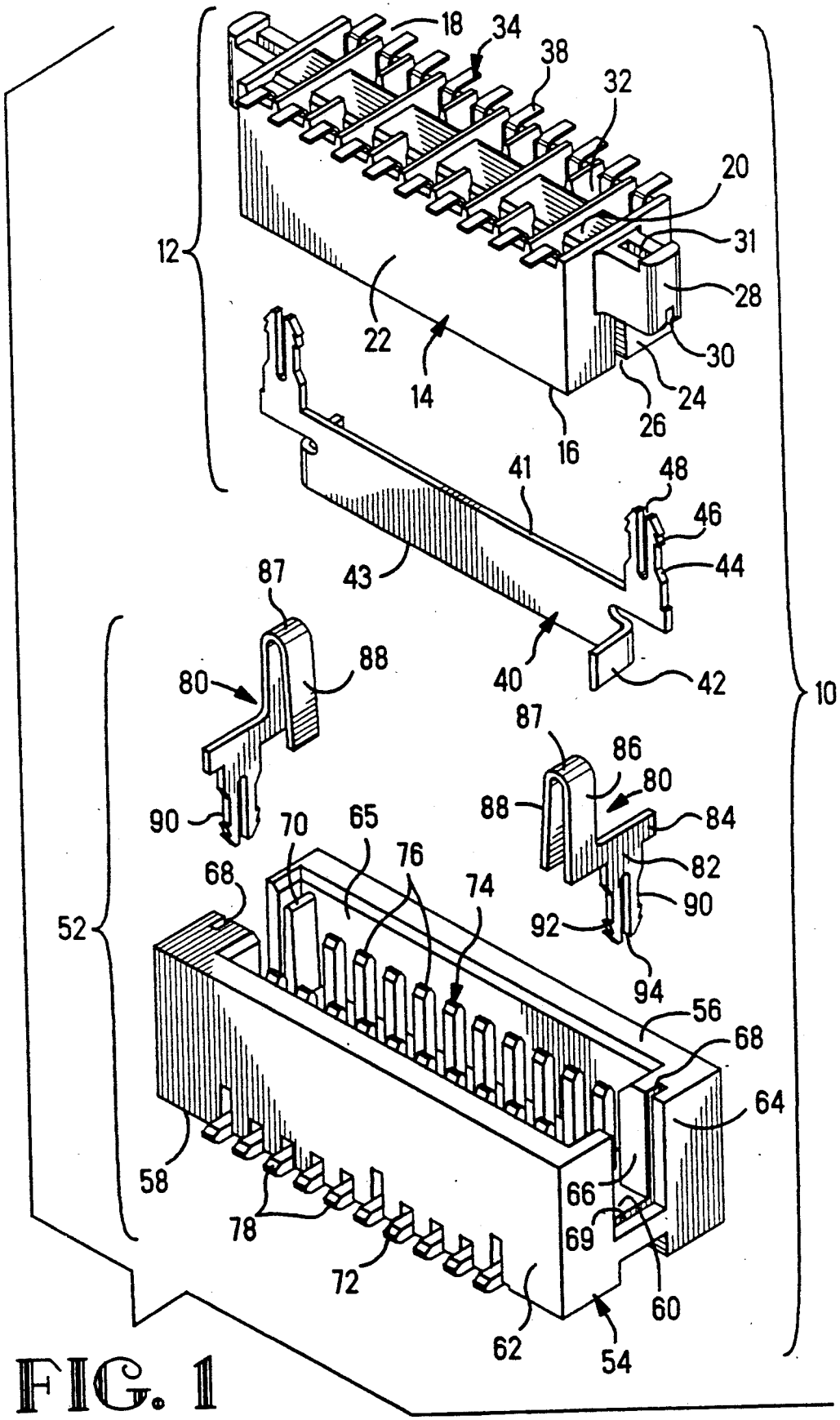
FIG. 1 is an exploded perspective view of the connector assembly made in accordance with the invention.

Referring now to FIGS. 1, 2, 3 and 4 connector assembly 10 is comprised of first and second connectors 12,52 having first and second ground engagement means 42,82 respectively. As best seen in FIGS. 1 and 2 first connector 12 is a receptacle connector having a housing 14 with a mating face 16 and opposed mounting face 18. Housing 14 includes a base 20, opposed side walls 22 and opposed end walls 24 having a slot 26 extending therethrough. End walls 24 further include outwardly extending flanges 28 having a slot 30 extending therethrough and having opening 31 therein exposed at the mounting face 18. Housing 14 includes a plurality of terminal receiving passageways 32 extending between the mating and mounting faces 16,18 respectively. Passageways 32 are arranged in at least two rows essentially parallel to the housing sidewalls 22. A plurality of terminal members 34, preferably surface mount terminal members, are disposed within respective passageways 32 forming two rows of terminal members 34. Terminal members 34 have first (not shown) and second connecting portions 38, the first connecting portions being accessible at the mating face for mating with corresponding terminal members of a mating connector and the second connecting portions 38 being surface mount contacts 38 exposed for mounting to circuit pads 97 on a first circuit board 96 as shown in FIG. 2.

Figure 4:
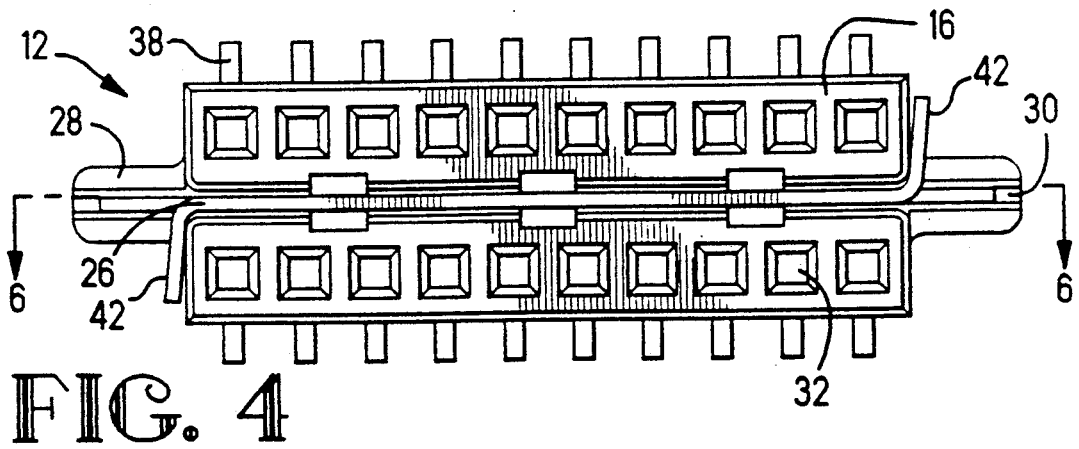
FIG. 4 is a top plan view of the receptacle of FIG. 2.

First connector 12 further includes an elongate ground bus means 40 having at least one first ground engagement means 42 integrally formed on the bus means 40 with the first ground engagement means 42 being a bent tab section, which as shown in the assembled connector 12 of FIG. 2 and in the top plan view of FIG. 4, is exposed along a portion of the outer surfaces of end walls 24. The elongate electrically conducted bus means 40 extends essentially parallel to the respective housing side walls 22 and is positioned between the at least two rows of terminal members 34 and is securable to the housing 20 proximate the end walls. In the preferred embodiment, the ground bus means is a continuous integral member extending substantially the full length of the housing and securable to the housing end walls. The bus means acts as a shield between the two rows of signal terminal members to prevent cross talk. In the preferred embodiment as shown in FIGS. 1, 2 and 4, the first ground engagement means 42 are formed at both ends of the bus means 40 and the bus means 40 extends between the parallel rows of terminal members 34 and through slots 26 in the end walls 24. Referring again the FIGS. 1 and 2, the lower edge of the bus means 40 includes board securing means 44, which extend downwardly through slots 31 in flanges 28 and as shown in FIG. 2 are adapted to engage the surfaces of the plated through-holes 98 of a circuit board 96 upon the first connector 12 being mounted thereto. Board securing means 44 is configured so that the horizontal width of means 44 is greater than the diameter of board hole 98, such that the outward extending barbs 46 on the board securing means 44 will cause an interference fit with the board hole 98 to hold the connector 12 to the board 96. In the preferred embodiment, the securing means 44 also includes a slot 48 which provides further compliancy for the securing means 44 as it enters the hole 98 and grips the internal surface thereof.

Referring now to FIGS. 1 and 3, second connector 52 is a plug member having a housing 54 with opposed mated and mounting faces 56,58. Housing 54 includes a base 60 having opposed side walls 62 and opposed end walls 64, which together define a cavity 65 for receiving the receptacle connector 12. End walls 64 include a slot 66 extending therethrough and into cavity 65, and dimensioned to receive a portion of the outward extending flange 28 of receptacle member 12 when connectors 12, 52 are mated. End walls 64 include a further slot 68 extending partially into the end walls 64, parallel to the outer surface thereof and essentially perpendicular to slot 66. Slot 68 extends to the internal surface of one of the side walls 62, and defines a ground receiving post 70 within cavity 65 proximate the side wall. In the preferred embodiment, two such ground receiving posts are defined at diagonally opposite ends of cavity 65. Slot 68 also includes a section 69, which extends through the base 60.

Connector 52 further includes a plurality of terminal members 74 disposed in the base terminal receiving passageways 72 within the base 60. The terminal members 74 are arranged in two parallel rows extend parallel to the side walls 62. Terminal members 74 include first connecting portions 76 adapted to mate with the corresponding mating terminal members of receptacle connector 12 and second connecting portions 78 extending outwardly from base 60 to be surface mounted to a second circuit board 102 and electrically connected with circuits 103 thereon.

Figure 5:
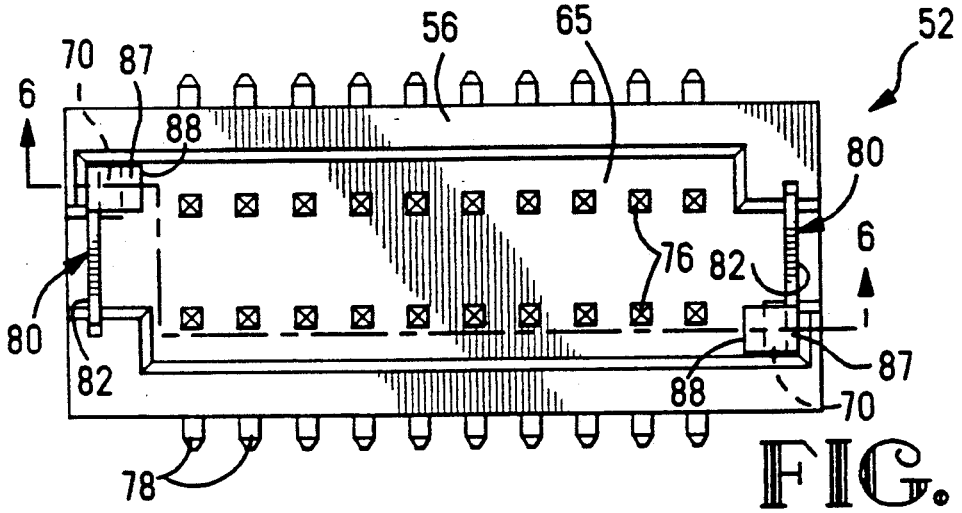
FIG. 5 is a top plan view of the plug of FIG. 3.

Connector 52 includes a ground contact means 80 having a second ground engagement means 88. In the preferred embodiment, second ground engagement means 88 is integral with ground contact means 80. Ground contact means 80 includes a cross bar member 82 having an upwardly extending U-shaped section 86 bent at 87, the inner leg 88 of the U defining the second ground engagement means. Cross bar 82 includes a locking tab portion 84 and a board securing means 90 extending in opposite direction from the U-shaped portion 86. Board securing means 90 is configured to be received in housing end wall slot 68 such that the portion 90 extends below the connector housing 54 and is adapted to be received in a corresponding through-hole 104 of a circuit board 102 to engage and secure the connector 52 thereto. The ground engaging means 90 includes a plurality of barbs 92, which are dimensioned to engage the surfaces of the through-hole 104 upon mounting connector 52 to the board 102 in the same manner as previously described with connector 12. As can be seen from FIG. 3, the ground contact 80 is secured in housing 54 by inserting ground contact means 90 through the lower portion of slot 68, the tab 84 into one end of slot 68 and the U-shaped section of the ground tab 80 is disposed over ground receiving post 70 within the cavity 65, thus having the ground contact 80 exposed at the mating face 56 of connector 52. The position of ground contacts 80 at the mating face 56 is more clearly seen in top plan view of FIG. 5.

Figure 6:
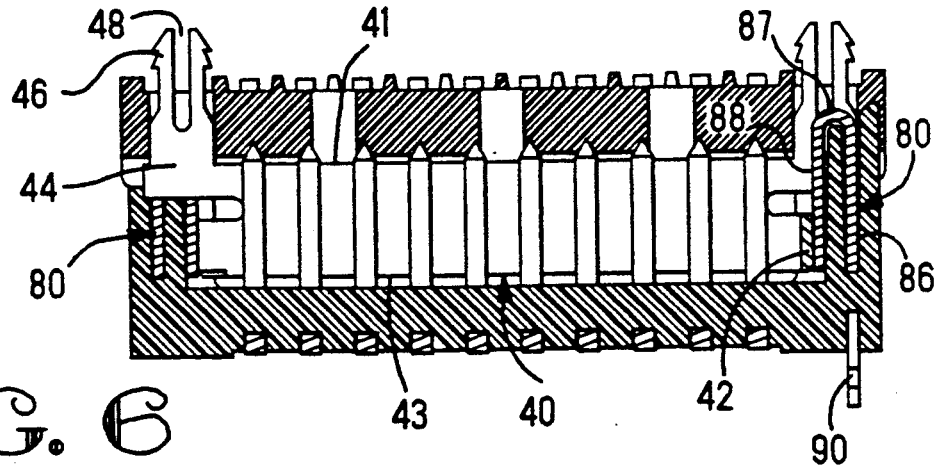
FIG. 6 is a longitudinal sectional view of the mated connector assembly, illustrating the interconnection of the ground means of the mated connectors, the receptacle being sectioned along the line 6—6 of FIG. 4 and the plug sectioned along the line 6—6 of FIG. 5.

Referring now to FIG. 6, which is a composite longitudinal section showing the mated connectors and the electrical engagement of the first and second ground engaging means 40, 80. Receptacle connector 12 is sectioned along the line 6—6 of FIG. 4 and plug connector 52 is sectioned along line 6—6 of FIG. 5. As shown in FIG. 6, when the first and second connectors 12, 52 are mated, the exposed ground engagement means 42,88 become engaged as the receptacle 12 is moved into cavity 65 of the plug connector 52. Since the first and second ground engagement means 42,88 are exposed proximate the mating faces 16,56 respectively, the ground engagement means 42,88 mate before the corresponding first connecting portions of terminal members 34,74, which are typically signal contacts. The first and second ground engagement means 42,88 are adapted to go past each other and bear against each other under spring bias as the connectors 12,52 are mated. Upon mounting and securing the respective connectors 12,52 to their respective circuit boards 96,102 and upon mating the mounted first and second connectors 12,52 the second connecting portions 38,78 of the terminal members 34,74 are electrically engaged with corresponding circuits of the associated circuit boards 96,102, the corresponding ones of the first connecting terminal portions of the first and second connectors are electrically engaged and the ground bus means 40 is electrically connected to the ground contact means 80 and ground means within the boards 96,102.

In the preferred embodiment the plug half has a ground contact exposed in both end walls of the connector so that the ground engagement means of the first connector engages the ground contacts at both ends thereof thus providing a plurality of short paths for the ground circuit.

In assembling the first and second connectors 12,52, the terminal members 34,74 are inserted within the respective passageways 32,72. In the receptacle connector 12 the ground bus 40 is disposed in the slot 30 such that the mounting means portions 48 are received within the slots 30 of the flanges and extend through opening 31 in the lower surfaces thereof. The bus bar extends longitudinally through the connector housing and parallel to the two rows of terminal members with the cantilevered beam first ground engagement portions 42 extending along the outside end wall portions with one facing in one direction and the other facing in the second direction. In assembling a plug half, the terminal members are disposed within the respective passageways and the ground contacts are slid into place such that the mounting portion 90 extends through slot 69 in the base 60 of the housing and the U-shaped beam portion is wrapped around ground receiving post 70 as best seen in FIG. 3. In the preferred embodiment, the connector housings are molded from suitable thermoplastic materials as known in the art and the terminal members, ground bus means and ground contact means are preferably made from alloys of copper and the like.

The connector assembly of the present invention provides a means whereby grounding may be provided between adjacent rows of signal contacts thereby minimizing cross talk and concomitantly therewith the ground members 40, 80 are used to secure the connectors 12,52 to the respective circuit boards 96,102, thereby minimizing the number of board through-holes required to mount the connectors 12, 52 to circuit boards 96, 102. Furthermore the ground contact 40 of the receptacle connector 12 is of sufficient height to provide the ground plate required for both mating connectors so that the plug half need only have ground contacts at the ends thereof. The cantilevered beam portions of the first and second ground engagement means provide sufficient spring bias to assure ground contact and are located proximate the mating faces of the connector so that they will engage or mate first and break last during the mating of the connectors.

It is thought that the electrical connector assembly of the present invention and many of its attendant advantages will be understood from the foregoing description. Changes may be made in the form, construction and arrangement of parts thereof without departing from the spirit or scope of the invention or sacrificing all of its material advantages.

What is claimed is:

1. An electrical connector assembly comprising:

first and second matable connectors, each adapted to be mounted to respective first and second circuit boards and to interconnect respective circuits between said boards upon said connectors being mated to one another;

each of said first and second connectors includes an insulated housing having a base, opposed sidewalls opposed endwalls, a mating face, a board mounting face, and a plurality of terminal-receiving passageways extending between said mating and mounting faces, said passageways being arranged in at least two rows essentially parallel to said housing sidewalls; and a plurality of electrical terminal members, each mounted within a respective terminal-receiving passageway in said at least two rows and defining parallel rows of terminal members, each terminal having a first connecting portion adapted to mate with a corresponding terminal member of said mating connector and a second connecting portion adapted to mate with circuits on the respective circuit board;

one of said first and second connectors further including an elongate electrically conductive ground bus means extending essentially parallel to said respective housing sidewalls, between said at least two rows of terminal members and securable to said housing proximate said endwalls thereof, said ground bus means including at least one first ground engagement means at an end thereof, said bus means end being proximate one of said endwalls, said ground bus means further including means for securing said respective housing to the associated one of said circuit boards and concomitantly therewith electrically interconnect said bus means to respective circuits of said one board;

said other of said first and second connectors includes at least one ground contact secured to only one of said respective endwalls of said other connector housing, said at least one ground contact including second ground engagement means adapted to electrically engage said first ground engagement means, said at least one ground contact further including means for insertion into an aperture of the other circuit board for securing said respective other housing to the associated other circuit boar and concomitantly therewith electrically interconnect said ground contact to ground means of the other of said circuit boards;

said first and second ground engagement means being exposed along respective mating faces to become engaged upon mating of said first and second connectors, said first and second ground engagement means being adapted to bear against each other under spring bias when said connectors are mated, whereby upon mounting and securing said first and second connectors to said respective circuit boards and upon mating said mounted first and second connectors, said second connecting portions of said terminal members are electrically engaged with corresponding circuits of the associated circuit boards, corresponding ones of said first connecting terminal portions of said first and second connectors are electrically engaged and said ground bus means is electrically connected to said ground contact and ground means of said assembly.

2. The electrical connector assembly of claim 1 wherein said at least one first ground engagement means is integral with said ground bus means.

3. The electrical connector assembly of claim 1 wherein said at least one second ground engagement means is integral with said ground contact.

4. The electrical connector assembly of claim 1 wherein said ground bus means is a continuous integral member extending substantially the full length of the housing and includes two said first ground engagement means.

5. The electrical connector assembly of claim 4 wherein said two first ground engagement means are integral with said ground bus means.

6. The electrical connector assembly of claim 1 wherein said second connector includes two ground contacts, each including a second ground engagement means.

7. The electrical connector assembly of claim 6 wherein each of said second ground engagement means is integral with a respective one of said two ground contacts.

8. An electrical connector assembly comprising:

first and second matable connectors, each adapted to be mounted to respective first and second circuit boards and to interconnect respective circuits between said boards upon said connectors being mated to one another;

each of said first and second connectors includes an insulated housing having a base, opposed sidewalls opposed endwalls, a mating face, a board mounting face, and a plurality of terminal-receiving passageways extending between said mating and mounting faces, said passageways being arranged in at least two rows essentially parallel to said housing sidewalls; and a plurality of electrical terminal members, each mounted within a respective terminal-receiving passageway in said at least two rows and defining parallel rows of terminal members, each terminal having a first connecting portion adapted to mate with a corresponding terminal member of said mating connector and a second connecting portion adapted to mate with circuits on the respective circuit board;

one of said first and second connectors further including an elongate electrically conductive ground bus means extending essentially parallel to said respective housing sidewalls, between said at least two rows of terminal members and securable to said housing proximate said endwalls thereof, said ground bus means including two first ground engagement means, one at each end thereof, said bus means ends being proximate said endwalls, said ground bus means further including means for securing said respective housing to the associated one of said circuit boards and concomitantly therewith electrically interconnect said bus means to respective circuits of said one board;

said other of said first and second connectors includes two ground contacts, each secured to only one of said respective endwalls of said other connector housing, each of said ground contacts including second ground engagement means adapted to electrically engage a corresponding one of said first ground engagement means, each of said ground contacts further including means for insertion into an aperture of the other circuit board for securing said respective other housing to the associated other circuit board and concomitantly therewith electrically interconnect said ground contacts to ground means of the other of said circuit boards;

said first and second ground engagement means being exposed along respective mating faces to become engaged upon mating of said first and second connectors, corresponding ones of said first and second ground engagement means being adapted to bear against each other under spring bias when said connectors are mated, whereby upon mounting and securing said first and second connectors to said respective circuit boards and upon mating said mounted first and second connectors, said second connecting portions of said terminal members are electrically engaged with corresponding circuits of the associated circuit boards, corresponding ones of said first connecting terminal portions of said first and second connectors are electrically engaged and said ground bus means is electrically connected to said ground contact and ground means of said assembly.

9. The electrical connector assembly of claim 8 wherein said two first ground engagement means are integral with said ground bus means.

10. The electrical connector assembly of claim 8 wherein each of said second ground engagement means is integral with a respective one of said two ground contacts.

* * * * *

UNITED STATES PATENT AND TRADEMARK OFFICE

CERTIFICATE OF CORRECTION

PATENT NO. : 5,183,405

DATED : Feb. 2, 1993

INVENTOR(S) : Elicker et al

It is certified that error appears in the above-indentified patent and that said Letters Patent is hereby corrected as shown below:

Claim 1, Column 6, Line 36 - The word "boar" should be --board--

Signed and Sealed this

Fifth Day of April, 1994

Bruce Lehman

*Attest:*

BRUCE LEHMAN

*Attesting Officer*

*Commissioner of Patents and Trademarks*